US010450773B2

(12) United States Patent
Wade-Smith

(10) Patent No.: US 10,450,773 B2
(45) Date of Patent: Oct. 22, 2019

(54) PARKING SPACE BARRICADE

(71) Applicant: Josephine Wade-Smith, Chicago, IL (US)

(72) Inventor: Josephine Wade-Smith, Chicago, IL (US)

( * ) Notice: Subject to any disclaimer, the term of this patent is extended or adjusted under 35 U.S.C. 154(b) by 442 days.

(21) Appl. No.: 15/211,255

(22) Filed: Jul. 15, 2016

(65) Prior Publication Data

US 2017/0016190 A1 Jan. 19, 2017

Related U.S. Application Data

(60) Provisional application No. 62/192,833, filed on Jul. 15, 2015.

(51) Int. Cl.

| | |
|---|---|
| ***E04H 17/16*** | (2006.01) |
| ***E01F 13/04*** | (2006.01) |
| ***E01F 13/02*** | (2006.01) |
| *E04H 17/14* | (2006.01) |

(52) U.S. Cl.

CPC ..... *E04H 17/16* (2013.01); *E01F 13/02* (2013.01); *E01F 13/042* (2013.01); *E04H 2017/1452* (2013.01); *E04H 2017/1491* (2013.01)

(58) Field of Classification Search

CPC ..... E01F 13/022; E01F 13/042; E01F 13/02; E01F 13/065; E01F 13/085; E04H 2017/1452; E04H 2017/1491; E04H 17/16

USPC ..... 256/26, 60, 65.02

See application file for complete search history.

(56) References Cited

U.S. PATENT DOCUMENTS

| | | | | | |
|---|---|---|---|---|---|
| 4,624,210 | A * | 11/1986 | Glass | E01F 9/688 | 116/63 P |
| 4,681,302 | A * | 7/1987 | Thompson | E01F 8/0035 | 256/13.1 |
| 4,880,210 | A * | 11/1989 | Cucksey | B66B 13/303 | 256/26 |
| 5,762,444 | A * | 6/1998 | Giannelli | B25H 1/06 | 116/63 P |
| 5,993,103 | A * | 11/1999 | Christensen | E01F 9/70 | 116/63 P |
| 7,540,682 | B1 * | 6/2009 | Christensen | E01F 13/022 | 116/63 P |
| 8,302,937 | B2 * | 11/2012 | Mettler | E01F 13/022 | 256/26 |
| 8,424,644 | B2 * | 4/2013 | D'Abbraccio | E01F 13/022 | 182/181.1 |
| 8,808,600 | B1 * | 8/2014 | Christensen | E01F 13/022 | 264/238 |
| 2003/0197165 | A1 * | 10/2003 | Perelli | E01F 13/02 | 256/26 |

(Continued)

*Primary Examiner* — Matthew R McMahon
(74) *Attorney, Agent, or Firm* — Erickson Law Group, PC

(57) ABSTRACT

A parking space barricade is disclosed. The barricade has a crossmember, a first pair of legs, and a second pair of legs. The crossmember has a first fork end and a second fork end. The first fork end is opposite the second fork end. The first pair of legs are joined at a first upper end. The first upper end has a first crossmember mount. The second pair of legs are joined at a second upper end. The second upper end has a second crossmember mount. The first fork end is pivotally connected to the first crossmember mount. The second fork end is pivotally connected to the second crossmember mount. The first and second pair of legs each are pivotal between a stored position and a deployed position.

18 Claims, 16 Drawing Sheets

(56) References Cited

U.S. PATENT DOCUMENTS

| | | | | |
|---|---|---|---|---|
| 2004/0188667 | A1* | 9/2004 | Ray | A01K 3/00 256/67 |
| 2007/0158628 | A1* | 7/2007 | Tsao | E04H 17/1443 256/19 |
| 2009/0013923 | A1* | 1/2009 | Lund | E01F 13/02 116/63 P |

* cited by examiner

PARKING SPACE BARRICADE

This application claims the benefit of U.S. Patent Application No. 62/192,833, filed on Jul. 15, 2015.

FIELD OF THE INVENTION

This invention relates in general to parking space barricades.

BACKGROUND OF THE INVENTION

Parking spaces are available for parking vehicles and other motorized devices. Often a driver or other person would like to reserve a parking space while removing the vehicle parked in the parking space so that the driver will be able to again park in the parking space when the driver returns. If the parking space is not reserved another driver may park in that parking space when the original driver leaves. Then upon return the original driver may need to search for another parking space, which may not be as close or as convenient as the parking space that the driver previously vacated.

The present inventor recognized the need for a device for reserving a parking space. The present inventor recognized the need for a lightweight and portable device for reserving a parking space. The present inventor recognized the need for a device that can be made smaller for storage when not in use. The present inventor recognized the need for a device for reserving a parking space that can be user-disassembled for storage.

SUMMARY OF THE INVENTION

A parking space barricade is disclosed. In some embodiments, the barricade comprises a crossmember, a first pair of legs, and a second pair of legs. The crossmember comprises a first fork end and a second fork end. The first fork end is opposite the second fork end.

The first pair of legs are joined at a first upper end. The first upper end comprises a first crossmember mount. The second pair of legs are joined at a second upper end, the second upper end comprises a second crossmember mount. The first crossbar mount is pivotally connected to the first fork end. The first pair of legs comprise a first vertical pivot axis extending through the first crossbar mount. The second crossbar mount is pivotally connected to the second fork end. The second pair of legs comprise a second vertical pivot axis extending through the second crossbar mount.

The first and second pair of legs comprise a deployed position and a stored position. In some embodiments, the first and second pair of legs each are pivotal between the stored position and the deployed position. The first and second pair of legs are transverse to the crossbar when in the deployed position. The first and second pair of legs are adjacent the crossbar when in the stored position.

Numerous other advantages and features of the present invention will become readily apparent from the following detailed description of the invention and the embodiments thereof, from the claims, and from the accompanying drawings.

DETAILED DESCRIPTION

Figure 1:
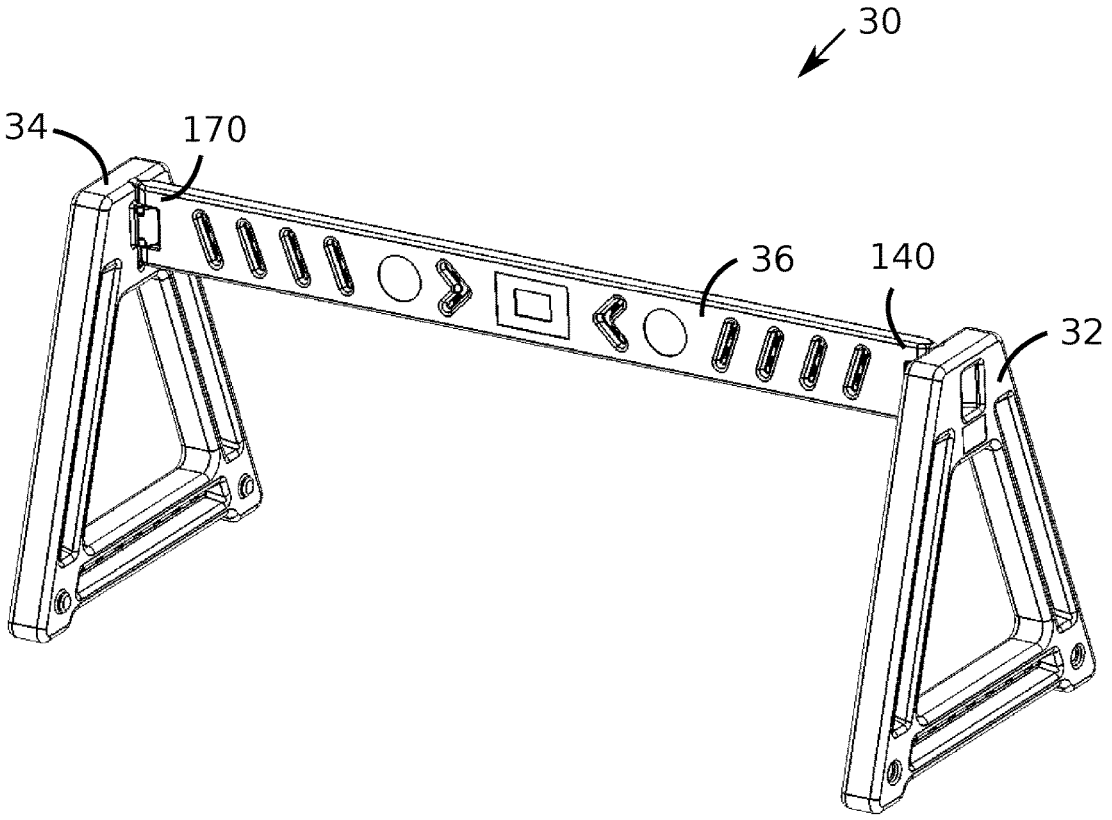
FIG. 1 is a front perspective view of a parking space barricade of the invention.

The following description is presented to enable any person skilled in the art to make and use the invention. For the purposes of explanation, specific nomenclature is set forth to provide a plural understanding of the present invention. While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

A parking space barricade 30 is disclosed. The barricade comprises a first A-frame 32, a second A-frame 34, and a crossbar 36. The crossbar is connected to and extends between the first and second A-frames.

Figure 2:
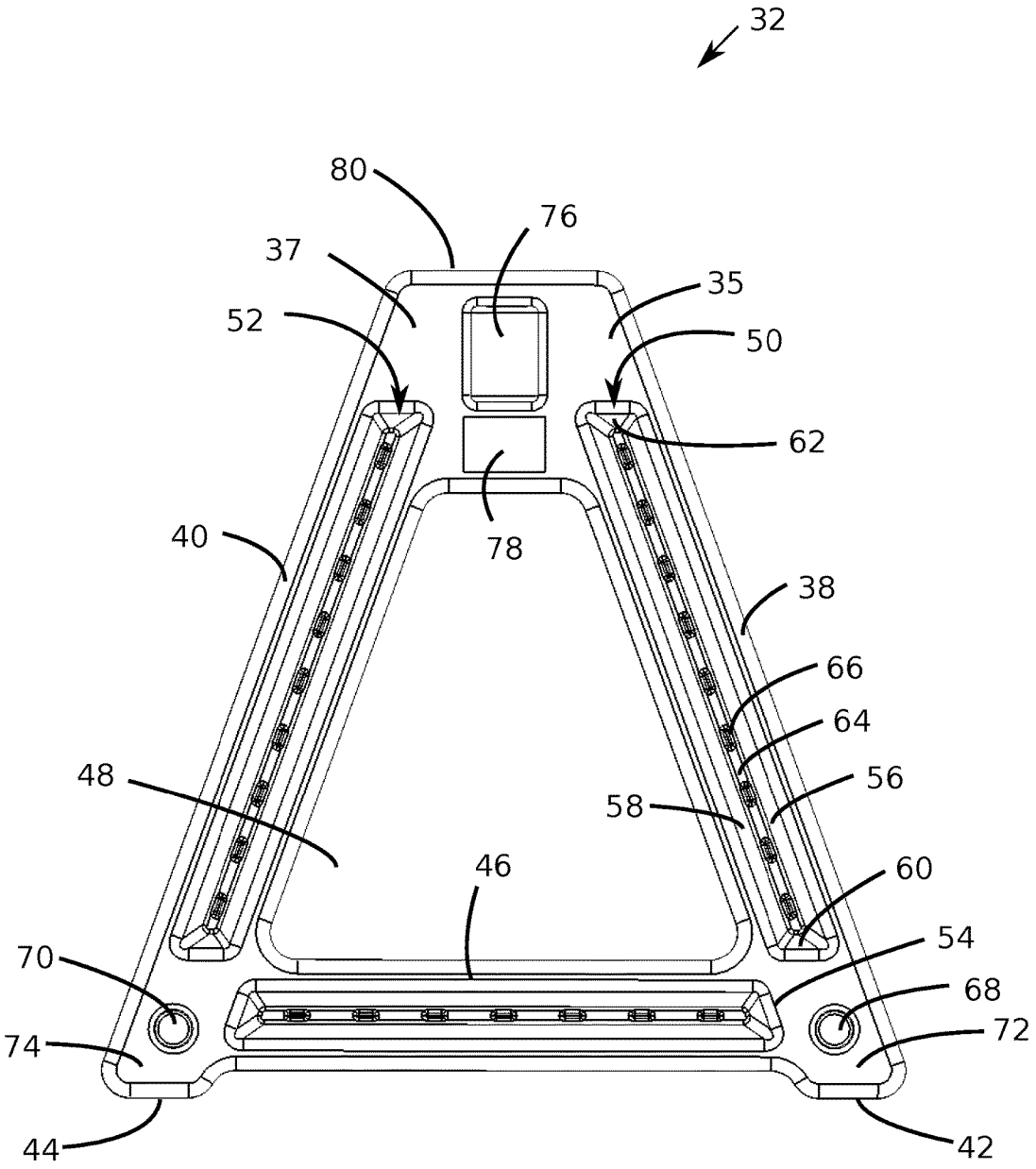
FIG. 2 is an outside view of an A-frame of the barricade of FIG. 1.

Each of the A-frames 32, 34 are identical so only one will be described in detail. Not all embodiments, require identical A-frames. The outside side 35 of A-frame 32 is shown in FIG. 2. The A-frame comprises an apex area 37, a first leg 38, and a second leg 40, a first foot 42, a second foot 44, and a crossmember 46. The first and second legs converge towards the apex area 37. The first and second legs diverged towards the first and second feet. The crossmember connects the first and second legs adjacent the feet. In some embodiments, the crossmember connects the first and second legs at a higher or lower location than is shown in the figures. The crossmember joins to the first and second legs at an interior side of the respective legs. In some embodiments, a crossmember is not provided so that the first and second legs are only joined at or about the apex area.

An open area 48 is provided between the crossmember 46 and the first and second legs 38, 40. In some embodiments, the open area 48 is not provided and the open area is filled or partially filled. In some embodiments, the bottom of the crossmember is co-planer or substantially co-planer with the feet so that a continuous bottom support surface extends between the legs.

Each of the legs and the crossmember comprise a recessed area 50, 52, 54. Recessed area 50 comprises a first sidewall 56, a second sidewall 58, a bottom wall 60, a top wall 62, a floor 64, and further recessed areas 66. The first and second sidewall converge toward the floor 64. The first and second sidewalls join with the floor. The top and bottom wall converge towards each other and join with the floor. The floor comprises further recessed areas 66 that are compressed for strength on opposite sides of the A-frame. Recessed area 52 and 54 are arranged similar to that of recessed area 50, as shown in the figures. Each of the legs 38, 40 comprise a lower stacking recess 68, 70. The lower stacking recess 68, 70 is located in the foot area 72, 74 adjacent the feet 42, 44 on the legs. The apex area 37 on the outside 35 comprises an upper stacking recess 76 and a recessed label area 78. The A-frame comprises a top surface 80.

Figure 3:
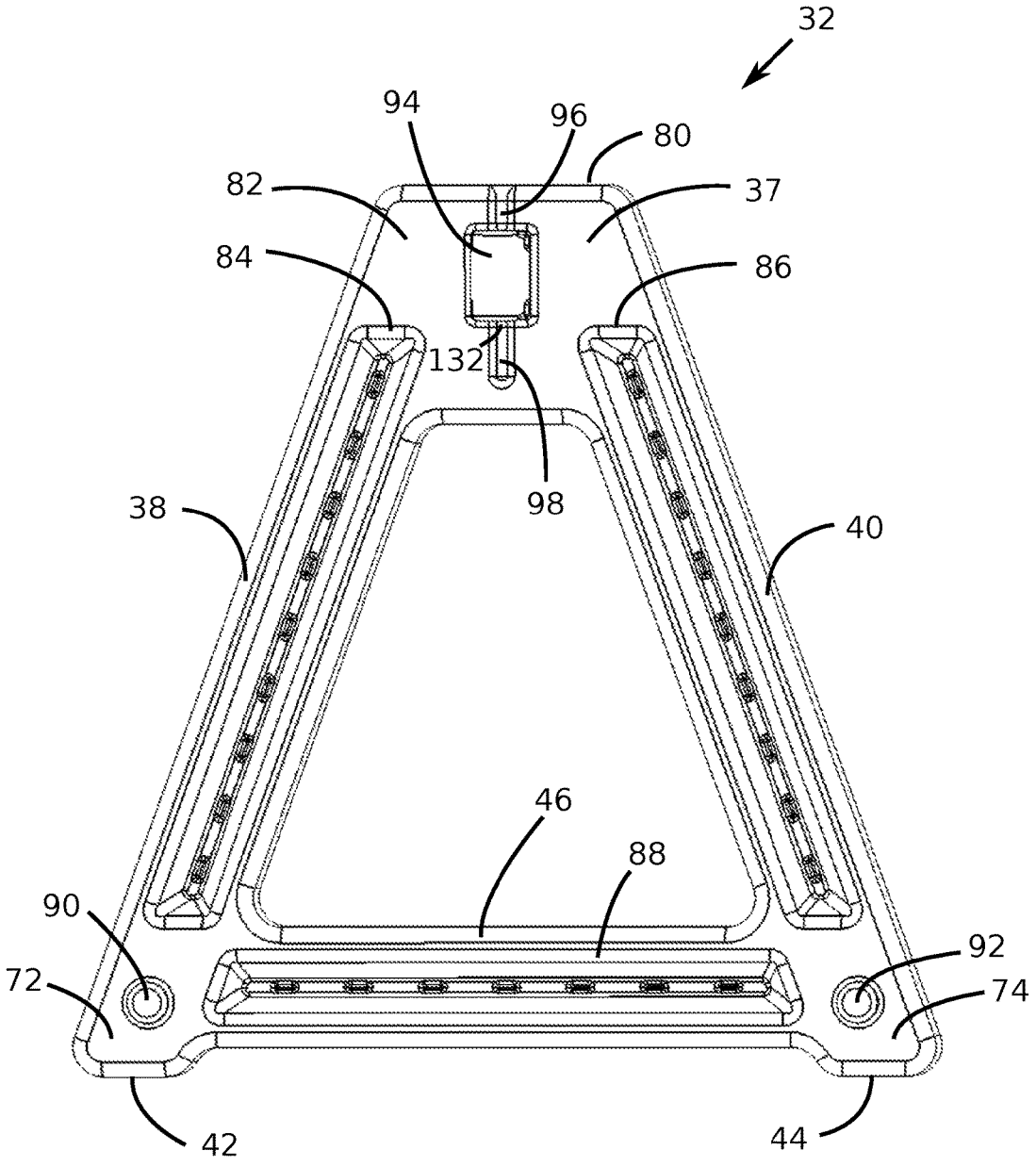
FIG. 3 is an inside view of the A-frame of FIG. 2.
Figure 5:
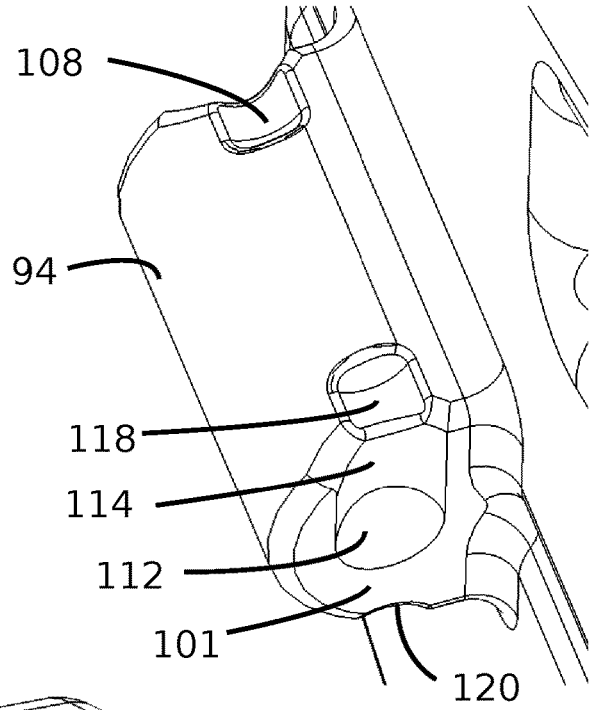
FIG. 5 is a lower perspective view of a portion of the A-frame of FIG. 3.
Figure 4:
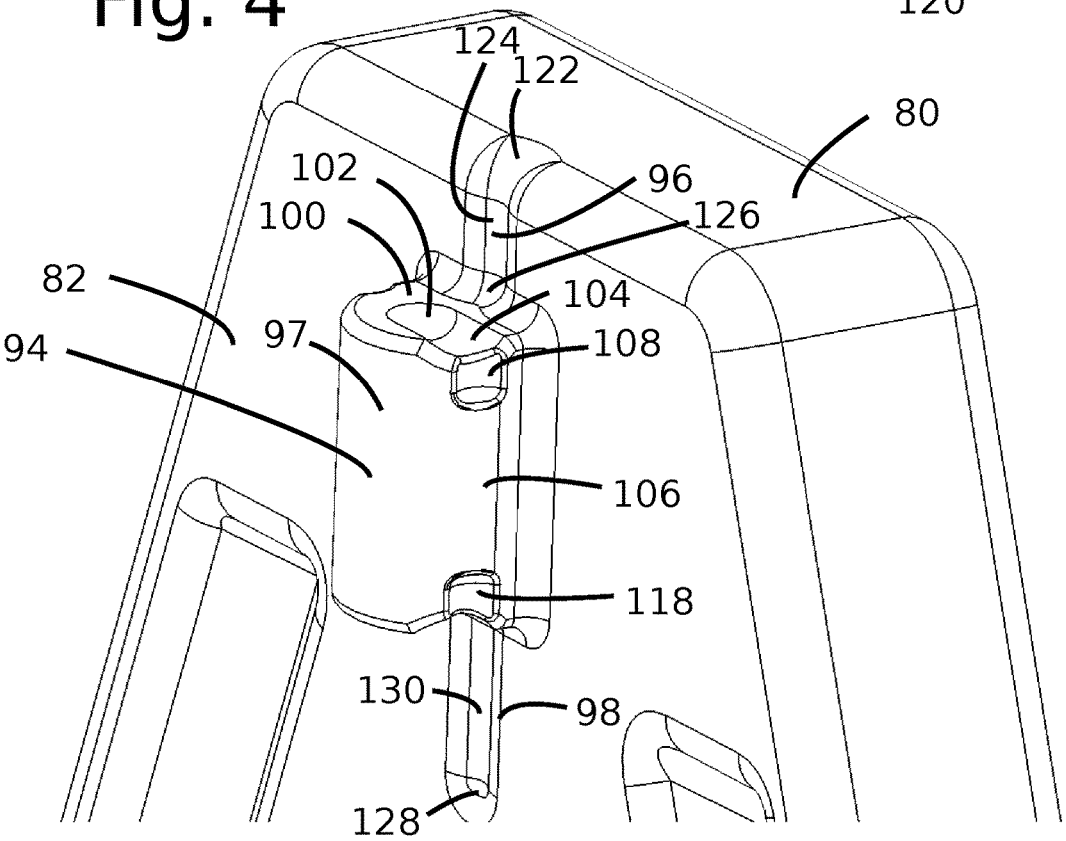
FIG. 4 is a perspective inside view of a portion of the A-frame of FIG. 3.
Figure 6:
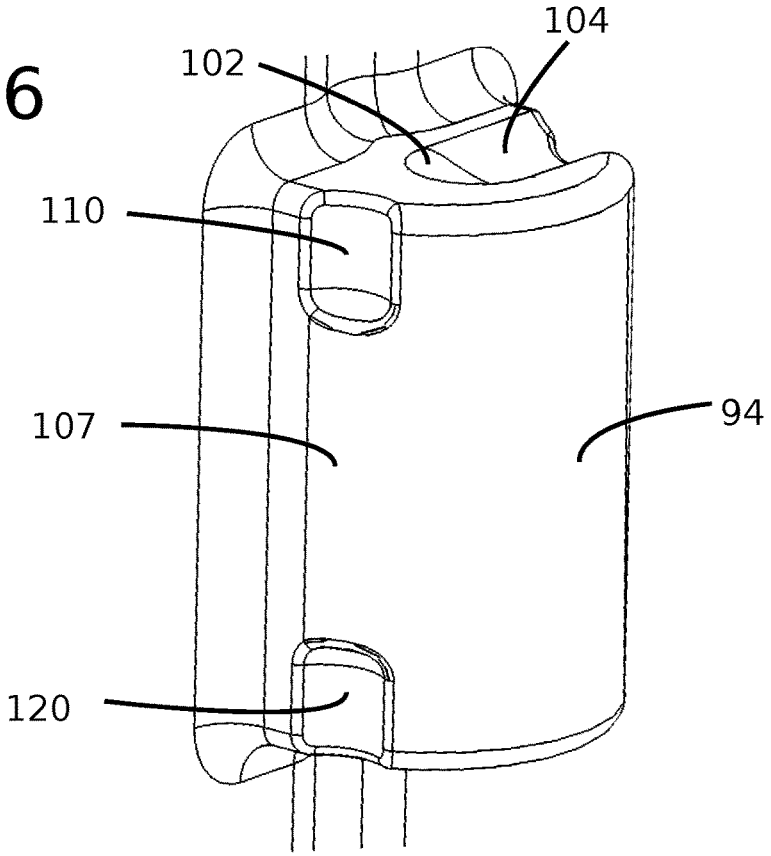
FIG. 6 is a side perspective view of a crossbar mount of the A-frame of FIG. 3.

FIG. 3 shows the inside side 82 of A-frame 32. The legs 38 and 40 on the inside 82 comprise recess areas 84, 86 that correspond to recessed areas 50, 52. Recessed areas 84, 86 are identical to recessed areas 50, 52. Crossmember 46 comprises recessed area 88 which is identical to recessed area 54. The foot areas 72, 74 on the inside 82 comprise lower stacking protrusions 90, 92.

The apex area 37 on the outside 35 comprises a crossbar mount 94, an upper crossbar stop recess 96, and a lower crossbar stop recess 98. The crossbar mount 94 is shown in more detail in FIGS. 4 through 8. The mount 94 comprises a generally curved side perimeter wall 97, a top surface 100, and a bottom surface 101.

Figure 8:
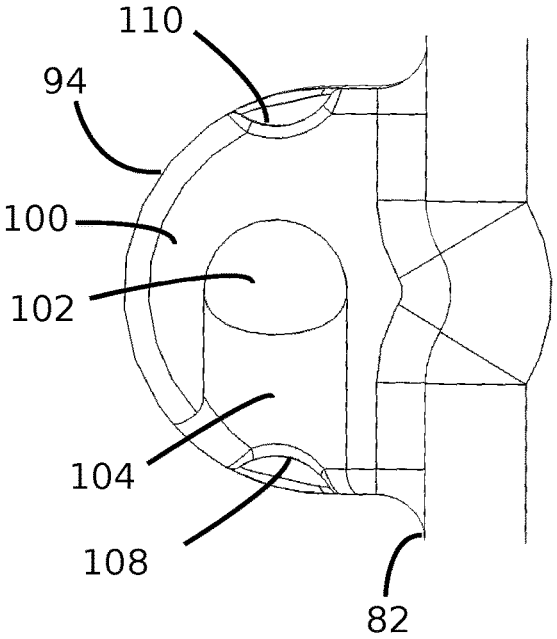
FIG. 8 is a top view of the crossbar mount of FIG. 6.

The top surface 100 comprises a top pivot recess 102 and a top guide channel 104. The mount 94 comprises first and second upper lock recesses 108, 110. The first and second upper lock recesses 108, 110 intersect with both the top surface 100 and the perimeter wall 97. The top channel 104 extends from the pivot recess to the perimeter wall at the upper lock recess 108, as is shown in FIG. 8. The first upper lock recess 108 is located on the perimeter wall adjacent 106 the inside wall 82 of the apex area 37. The second upper lock recess 110 is located on the perimeter wall adjacent 107 the inside wall 82 of the apex area 37.

Figure 7:
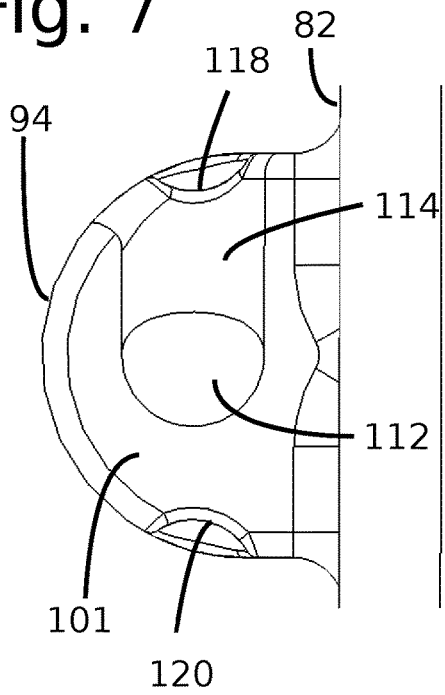
FIG. 7 is a bottom view of the crossbar mount of FIG. 6.

The bottom surface 101 comprises a bottom pivot recess 112 and a bottom guide channel 114. The mount 94 comprises first and second lower lock recesses 118, 120. The first and second lower lock recesses 118, 120 intersect with both the bottom surface 101 and the perimeter wall 97. The bottom channel 114 extends from the pivot recess 112 to the perimeter wall 97 at the lower lock recess 118, as is shown in FIG. 7. The first lower lock recess 118 is located on the perimeter wall adjacent 106 the inside wall 82 of the apex area 37. The first lower lock recess 118 is located on the perimeter wall adjacent 107 the inside wall 82 of the apex area 37.

In some embodiments, the mount 94 is shaped as a half cylinder, and the upper and lower surfaces 100, 101 each comprise a half circle shape.

The upper crossbar stop recess 96 comprises a wider mouth area 122, a main channel 124, and a narrowing end 126. The lower crossbar stop recess 98 comprises a circular bottom 128, a main channel 130, and a narrowing upper end 132.

Figure 9:
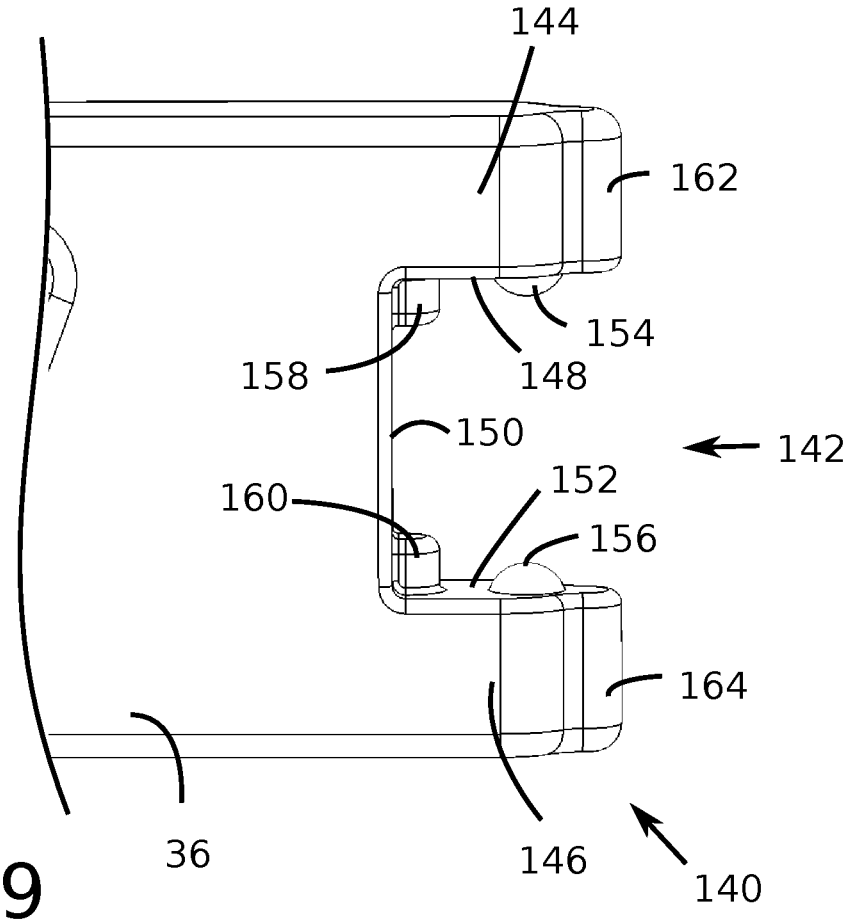
FIG. 9 is a front view of a first end portion of the crossbar of the barricade of FIG. 1.
Figure 10:
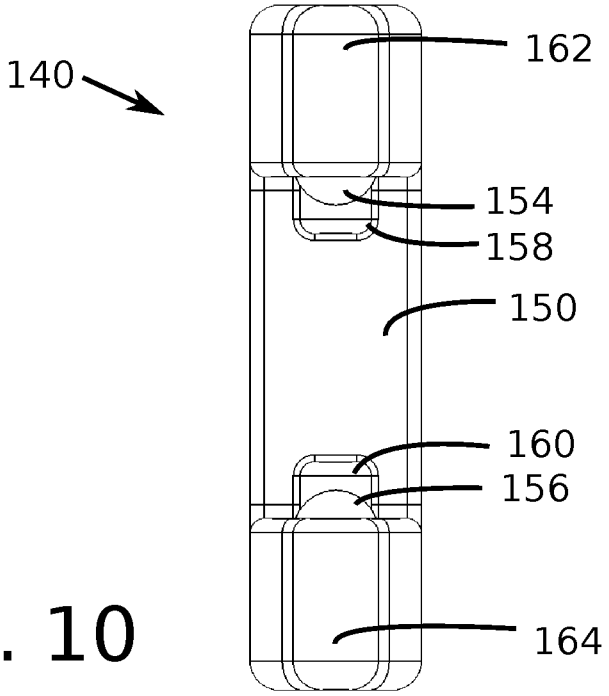
FIG. 10 is a first end view of the crossbar of FIG. 9.

FIGS. 9 and 10 show a first end 140 of the crossbar 36. The end 140 comprises a mount opening 142 and upper and lower fork arms 144, 146. The mount opening comprises an upper surface 148, a lower surface 152, and a back surface 150. The upper surface 148 comprises an upper pivot protrusion 154. The lower surface 152 comprises a lower pivot protrusion 156. The upper and lower pivot protrusions 154, 156 are aligned vertically.

At the intersection of the upper surface 148 and the back surface 150 is an upper pivot lock protrusion 158. At the intersection of the lower surface 152 and the back surface 150 is a lower pivot lock protrusion 160. In some embodiments, the upper and lower pivot lock protrusions 158, 160 have a height that is taller than the upper and lower pivot protrusion 154, 156, as is shown in FIGS. 9 and 10. The end of each fork 144, 146 comprises a locking rail 162, 164. In some embodiments, the second end 170 of the crossbar 36 is mirror image identical to the first end 140 about a vertical mid-line of the crossbar.

Figure 11:
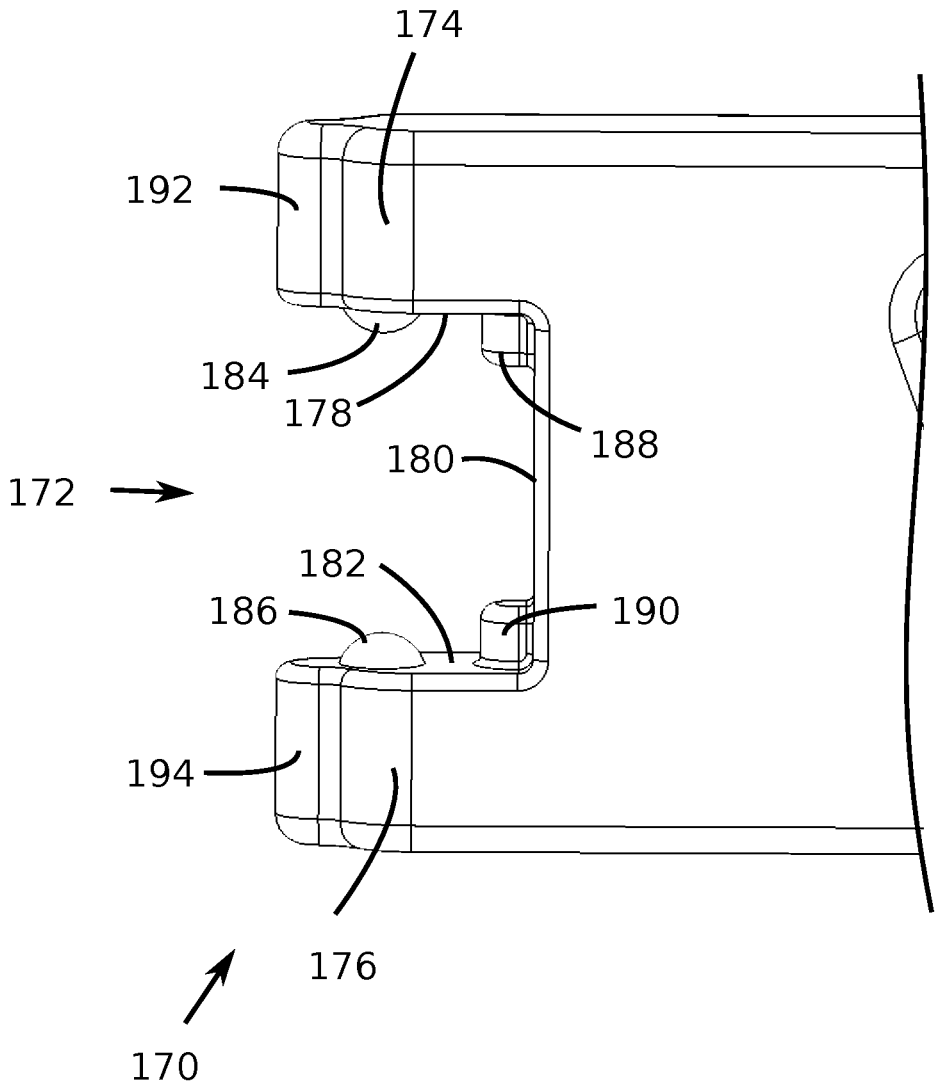
FIG. 11 is a front view of a second end portion of the crossbar of the barricade of FIG. 1.

FIG. 11 shows a second end 170 of the crossbar 36. The end 170 comprises a mount opening 172 and upper and lower fork arms 174, 176. The mount opening comprises an upper surface 178, a lower surface 182, and a back surface 180. The upper surface 178 comprises an upper pivot protrusion 184. The lower surface 182 comprises a lower pivot protrusion 186. The upper and lower pivot protrusions 184, 186 are aligned vertically.

At the intersection of the upper surface 178 and the back surface 180 is an upper pivot lock protrusion 188. At the intersection of the lower surface 182 and the back surface 180 is a lower pivot lock protrusion 190. In some embodiments, the upper and lower pivot lock protrusions 188, 190 have a height that is taller than the upper and lower pivot protrusion 184, 186, as is shown in FIG. 11. The end of each fork 174, 176 comprises a locking rail 192, 194.

Figure 12:
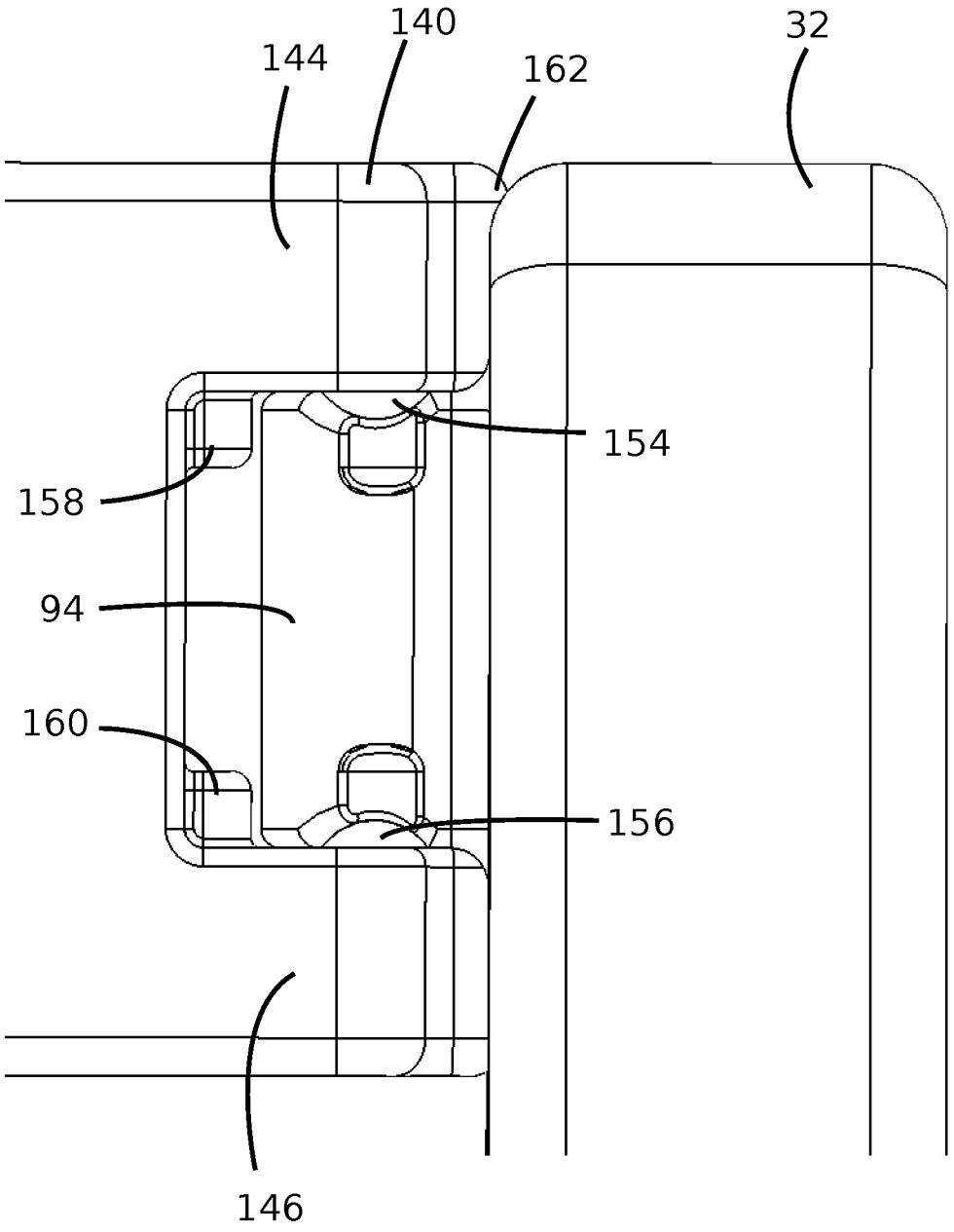
FIG. 12 is a front view of a portion of the barricade of FIG. 1 showing the first end portion of the crossbar and a portion of the A-frame.
Figure 13:
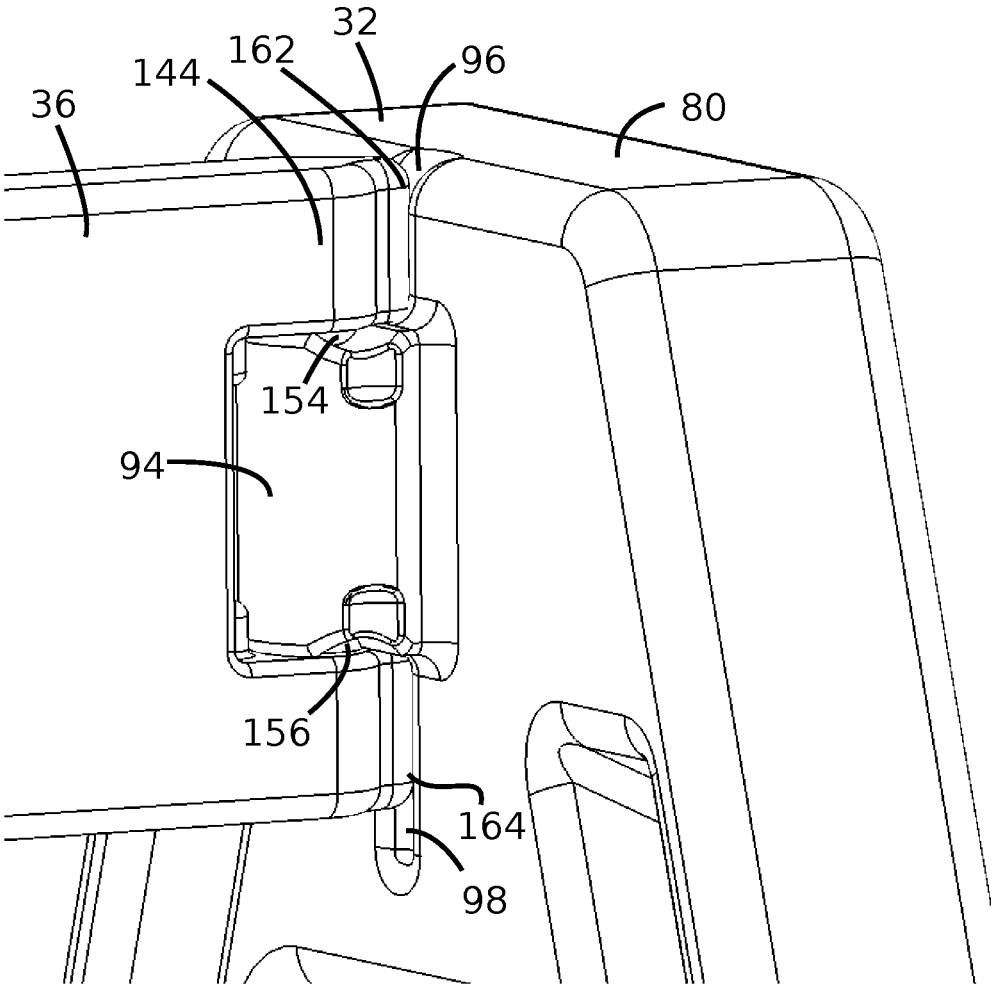
FIG. 13 is a front perspective view of a portion of the barricade of FIG. 1 showing the first end portion of the crossbar and a portion of the A-frame.

FIGS. 12 and 13 show the first end 140 of crossbar 36 engaged with the first A-frame 32 in a deployed position. The upper pivot protrusion 154 is received and seated in a top pivot recess 102 of the mount 94. The lower pivot protrusion is received and seated in the bottom pivot recess 112. The crossbar 36 and A-frame 32 are secured against pivotal movement relative to the other at the top and bottom pivot recesses by the locking rails 162, 164 being located within the respective upper and lower crossbar stop recesses 96, 98. Therefore, the crossbar will remain transverse, or in some embodiments perpendicular, to the A-frame 32 by the locking rail 162, 164 being located within the respective upper and lower crossbar stop recesses 96, 98. Similarly, the crossbar will remain transverse, or in some embodiments perpendicular, to the A-frame 34 by the locking rails 192, 194 being located within the respective upper and lower crossbar stop recesses of A-frame 34.

The top and bottom pivot recesses 102, 112 are recessed further than the top and bottom channels 104, 114, so that while a portion of the upper and lower pivot protrusions 154, 156 are visible in FIG. 12 a portion of the upper and lower pivot protrusions 154, 156 are not visible and is seated in the top and bottom pivot recess 102, 112, respectively.

Figure 14:
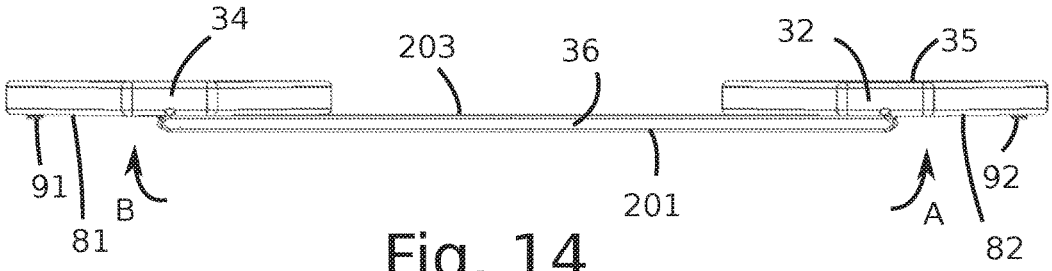
FIG. 14 is a top view of the barricade of FIG. 1 shown in a first stored position.
Figure 15:
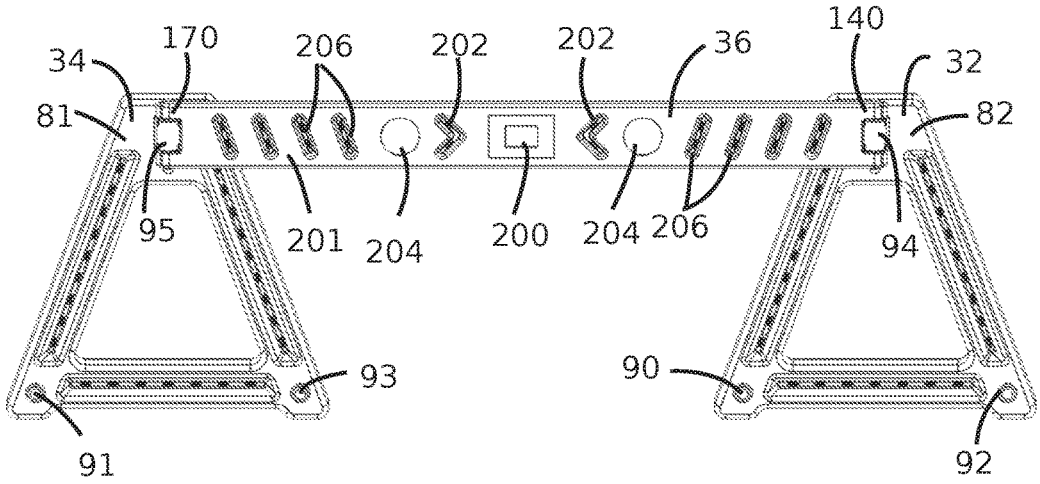
FIG. 15 is a front view of the barricade of FIG. 14.

FIGS. 14 and 15 show that the barricade 30 in a first stored position where the A-frames 32, 34 are positioned longitudinally and overlapping the crossbar 36. When in the storage position the barricade 30 has a more compact configuration.

The crossbar 36 has a front side 201 and an opposite back side 203. The front and back side are mirror image identical about a vertical midplane extending along a longitudinal length of the crossbar. The front side 201 of the crossbar 36 comprises a laterally centrally located ID tag or label pocket or recess 200. Adjacent the label recess on opposite sides are arrow recesses 202. Adjacent the arrow recesses on a side opposite the label recess are logo recesses 204. The logo recesses may be circular in shape or may comprise other shapes. Adjacent the logo recesses opposite the label recess 200 are angled linear recesses 206. There are four angled linear recesses 206 shown in the drawings but any number of these recesses 206 or the other recesses 204, 202, 200 may be provided.

To move the barricade 30 from the deployed configuration as shown in FIG. 1 to the first storage position as shown in FIGS. 14 and 15, A-frame 32 is rotated in a direction A, of FIG. 14, about crossbar mount 94 until the inside wall 82 is in contact with or is adjacent to the back side 203 of the crossbar 36 at the first end 140. Similarly, A-frame 34 is rotated in direction B about crossbar mount 95 until the inside wall 81 is in contact with or is adjacent to the back side 203 of the crossbar 36 at the second end 170. When a predetermined amount of force is applied to the A-frame 32 in direction A of FIG. 14, the locking rails 162, 164 is released from engagement within the respective upper and lower crossbar stop recesses 96, 98. Therefore, the locking rails 162, 164 is engaged within the upper and lower crossbar stop recesses 96, 98. And the predetermined amount of force applied to A-frame 32 to release the engagement of the locking rails 162, 164 with the recesses 96, 98, would be such that a human user could overcome the frictional and/or recessed engagement by applying manual force. Similarly, A-frame 34 can be rotated in direction B to overcome the engagement between the locking rail at the second end 170 and the crossbar recesses of A-frame 34.

Figure 19:
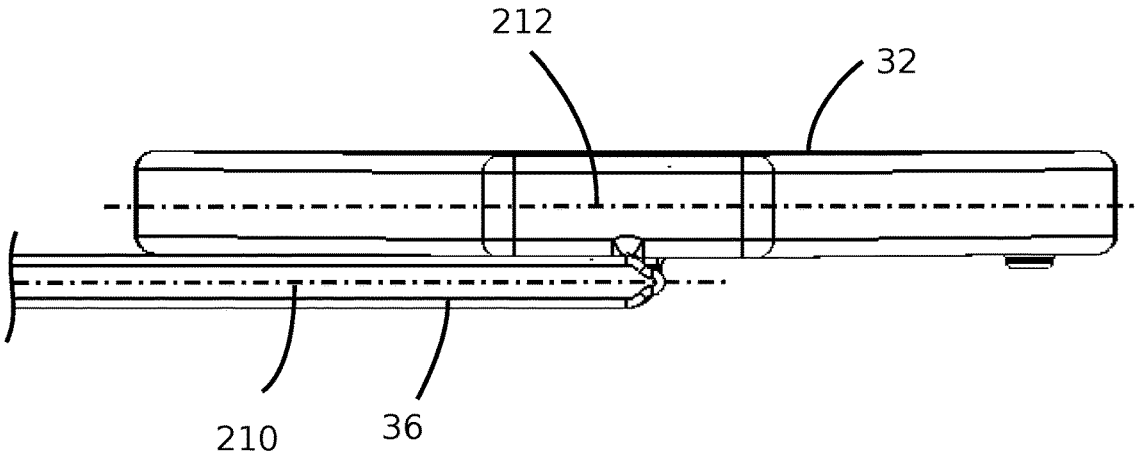
FIG. 19 is a top view of a portion of the barricade taken from FIG. 14.

FIG. 19 shows the A-frame 34 in the first stored position. The A-frame 32 is in an overlapped position relative to the crossbar. A top longitudinal centerline 210 of the crossbar 36 is parallel to a top longitudinal centerline 212 of the A-frame. In some embodiments, the A-frame is parallel to the crossbar and there is a gap between the A-frame 32 and the crossbar 36 when in the first or second stored position. In some embodiments, there is no gap as is shown in FIG. 19.

Figure 16:
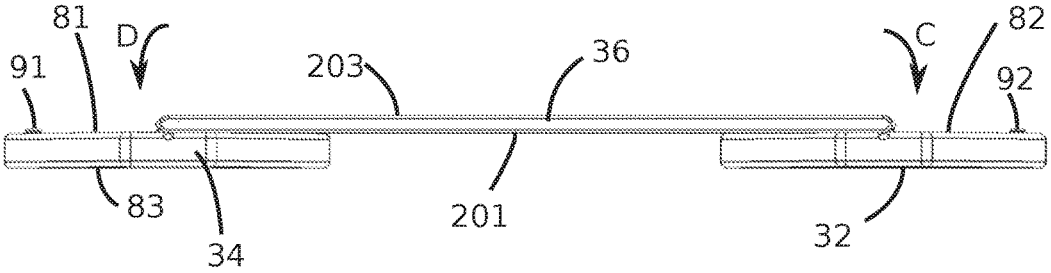
FIG. 16 is a top view of the barricade of FIG. 1 shown in a second stored position.

FIG. 16 shows the barricade 30 in a second stored position. The A-frames 32, 34 are rotated in a direction opposite of that shown in FIGS. 14 and 15. Therefore, the A-frames have a 180 degrees range of rotational positions about each respective end of the crossbar 36. FIG. 16 shows that A-frame 32 is rotated in the direction C ninety degrees from the position shown in FIG. 1 so that the inside 82 of the A-frame 32 is in contact or adjacent the front side 201 of the crossbar 36. Similarly, A-frame 34 is rotated in the direction D ninety degrees from the position shown in FIG. 1 so that the inside 81 of the A-frame 34 is in contact or is adjacent the front side 201 of the crossbar 36. The locking rails of the ends 140, 170 exit the upper and lower crossbar stop recesses of the respective ends 140, 170 in the same manner as described above in reference to FIGS. 14 and 15 when the predetermined amount of force is applied. A-frame 32 pivots about a vertical axis extending through the pivot recess 102, 112 and the pivot protrusions 154, 156. A-frame 34 is similarly pivotal about a vertical axis extending through the pivot recess of the mount 95 and the pivot protrusions 184, 186.

The engagement of the locking rails with the crossbar stop recesses at the respective ends 140, 170 keeps the A-frames in the deployed position shown in FIG. 1 relative to the crossbar 36, until a predetermined amount of force is applied to move one or both A-frames to the first or second stored position. As the A-frames move independently of one another, one A-frame can be provided in the first stored position and the other A-frame can be provided in the second stored position so that each A-frame is located on an opposite side of the crossbar 36. Further, one A-frame can be in the first or second stored position while the other A-frame is in the deployed position.

Figure 17:
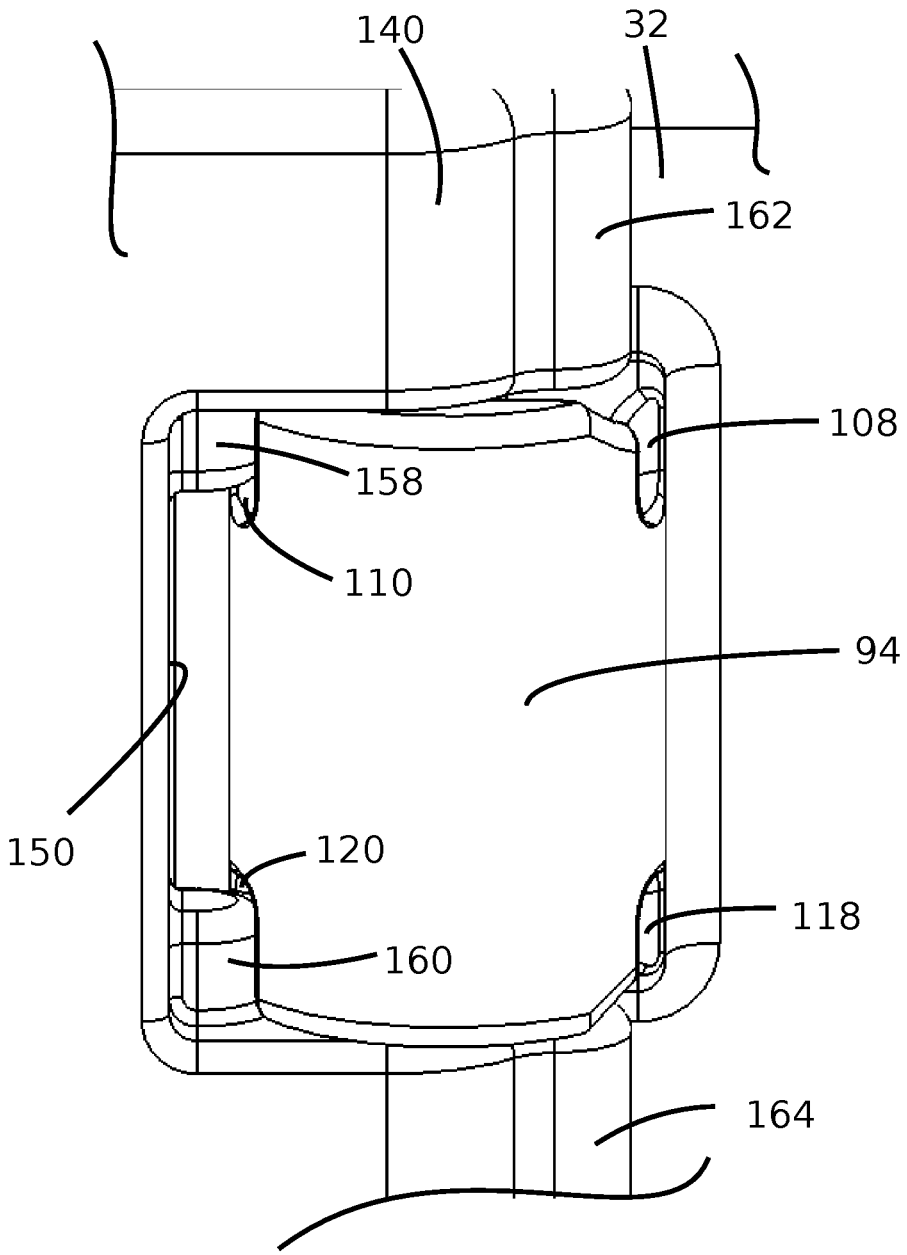
FIG. 17 is a front perspective view of a portion of the barricade of FIG. 14 in the first stored position, showing the first end portion of the crossbar and a portion of the A-frame.

FIG. 17 shows that the upper pivot lock protrusion 158 is received in the second upper lock recess 110 of the mount 94 and the lower pivot lock protrusion 160 is received in the second lower lock recess 120. This maintains the A-frame 32 in the first stored position until a predetermined amount of force is applied in the direction C to force the upper and lower lock protrusions 158, 160 out of the second upper and second lower lock recesses 110, 120. When the A-frame 32 is positioned in the second stored position, shown in FIG. 16, the upper and lower lock protrusions 158, 160 are received in the first upper and first lower lock recesses 108, 118.

When the barricade is in the deployed position and located on an external flat or substantially flat support surface, the crossbar will be parallel or substantially parallel to the flat support surface. In some embodiments, the A-frames 32, 34 will be perpendicular to the flat support surface and to the crossbar. In some embodiments, the A-frames 32, 34 will be transverse to the flat support surface and transverse to the crossbar. In some embodiments, when the A-frames are moved between the first stored position, the deployed position, and second stored position, the A-frames remain perpendicular to the flat support surface.

Figure 18:
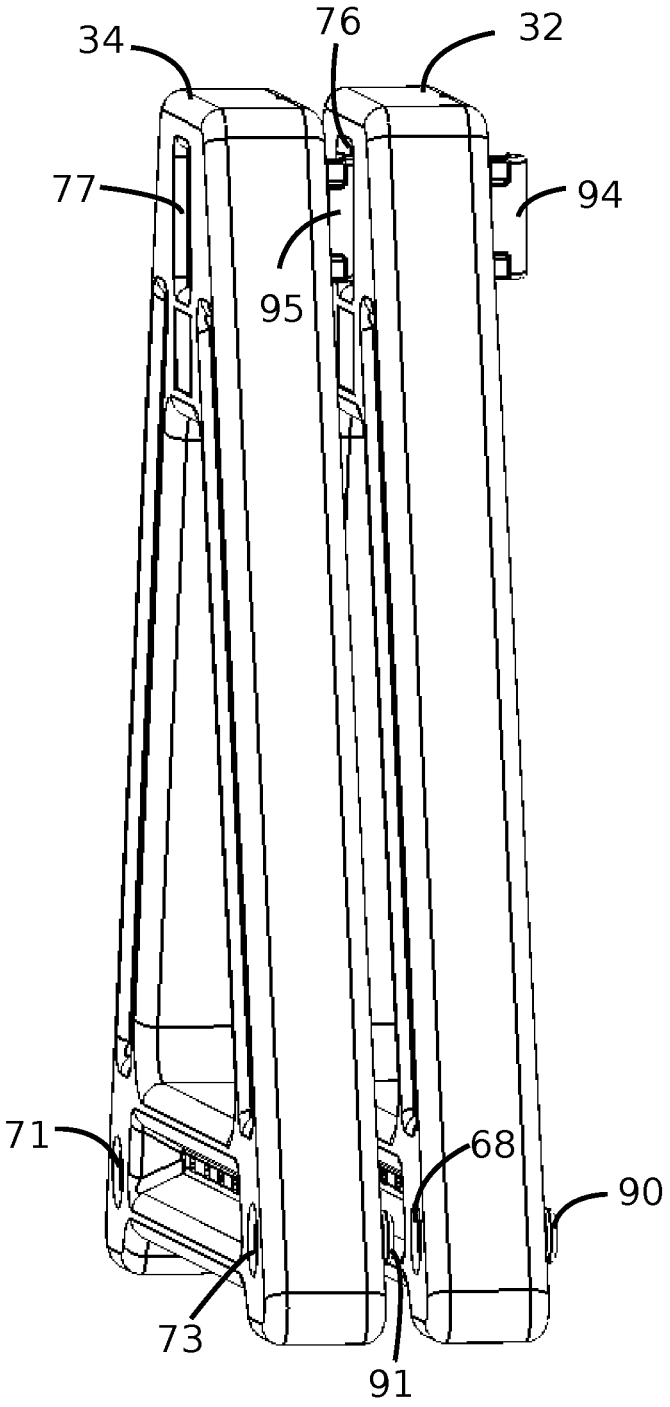
FIG. 18 is a side perspective view of the two A-frames of the barricade of FIG. 1 shown disconnected from the crossbar and arranged close to each other.

FIG. 18 shows that the A-frames 32, 34 can be disconnected from the crossbar 36 and stacked on or next to each other. The A-frames are shown slightly separated from each other to show the alignment features, but they can be positioned closer to each other than is shown in FIG. 18. The mount 95 of A-frame is received in the upper stacking recess 76 of A-frame 32, the lower stacking protrusions 91, 93 of A-frame 34 are received in the lower stacking recess 68, 70 of A-frame 32. In like manner another A-frame can be received on the lower stacking protrusions 90, 92 and mount 94 of A-frame 34 at the right in FIG. 18.

Another A-frame can be received in the lower stacking recesses 71, 73 and upper stacking recess 77 of A-frame 34 at the left in FIG. 18. Successive A-frames can be stacked in like fashion on either side of an A-frame.

To remove the crossbar 36 from the mounts 94, 95, separating force is applied to the crossbar and/or the corresponding A-frame to drive the upper and lower pivot protrusions 154, 156 from the top and bottom pivot recesses 102, 112, into the top and bottom channels 104, 114 and off of the mount. Reversing those steps, the crossbar can be mounted to the mounts 94, 95.

In some embodiments, the barricade or any component of the barricade is made of or comprises a thermoplastic, such as polyethylene, a metal, a wood, or other materials or composites. The polyethylene maybe the polyethylene described in U.S. Patent Application No. 62/192,833, filed on Jul. 15, 2015, which is herein incorporated by reference.

A method of reserving a parking space is disclosed. The barricade is moved or carried to the desired parking space to be reserved, the A-frames 32, 34 are moved to the deployed position. The barricade is position on the ground in, at, or adjacent the parking space to prevent or to deter others from parking a vehicle in the parking space. The barricade can be removed from the parking space by moving the barricade from the parking space to a temporary or permanent storage location. The A-frames 32, 34 can be moved to the first or second stored position before or after the barricade is moved to the temporary or permanent storage location.

Figure 20:
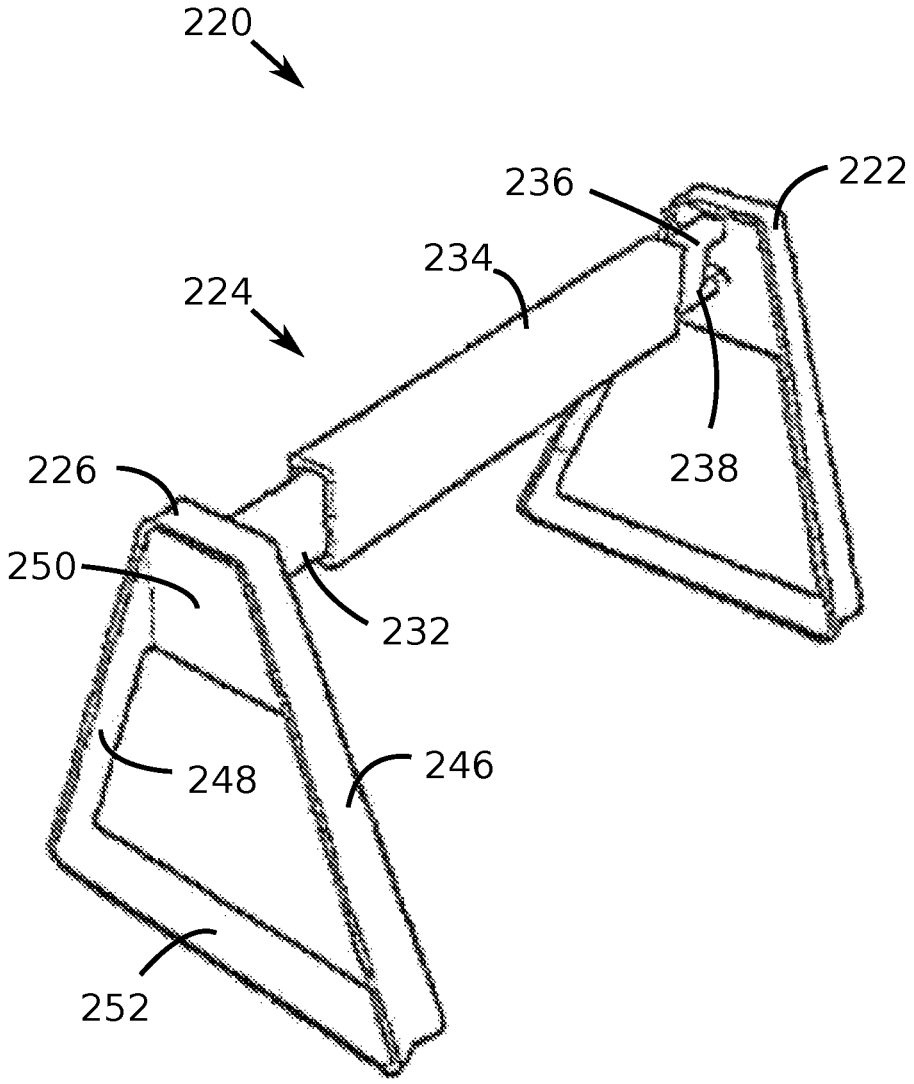
FIG. 20 is a perspective view of a second embodiment parking space barricade of the invention.
Figure 21:
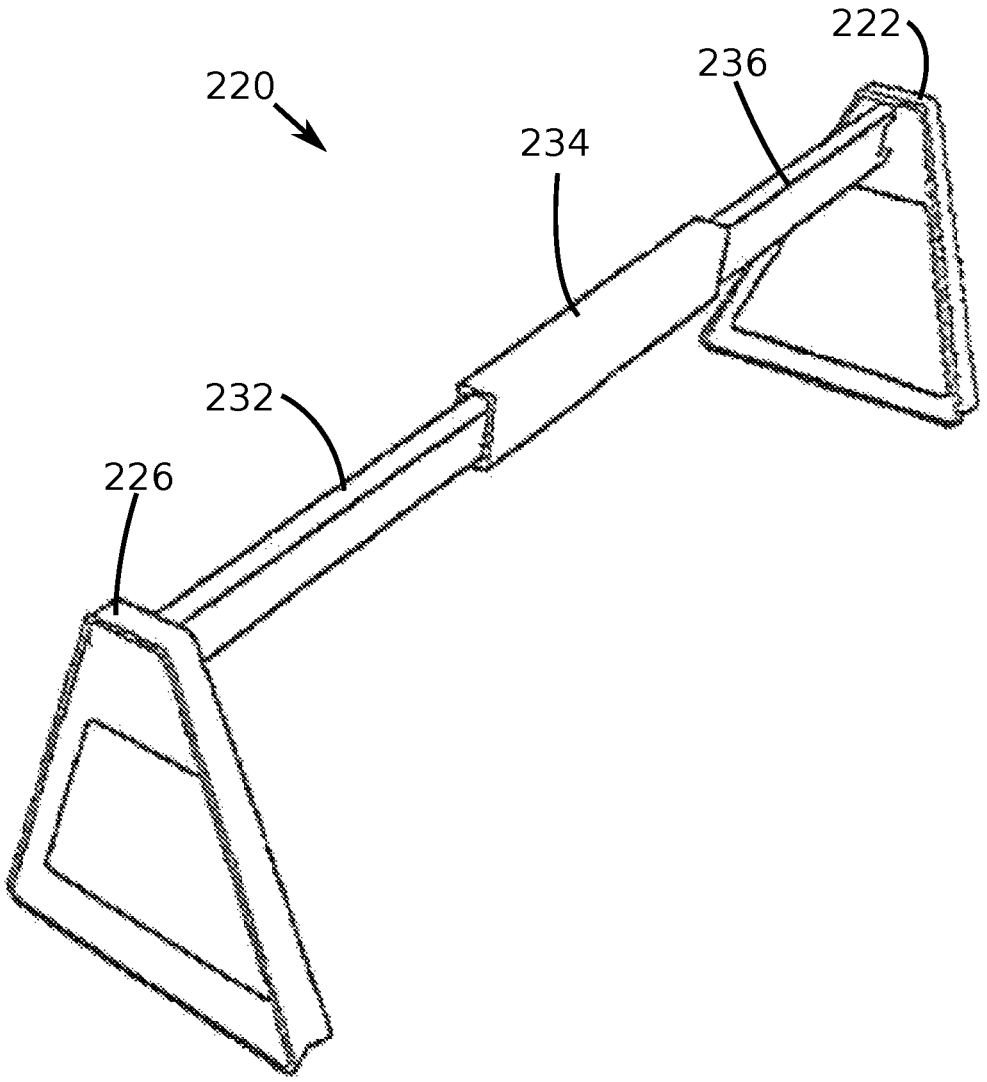
FIG. 21 is a perspective view of the barricade of FIG. 20 in an expanded configuration.
Figure 22:
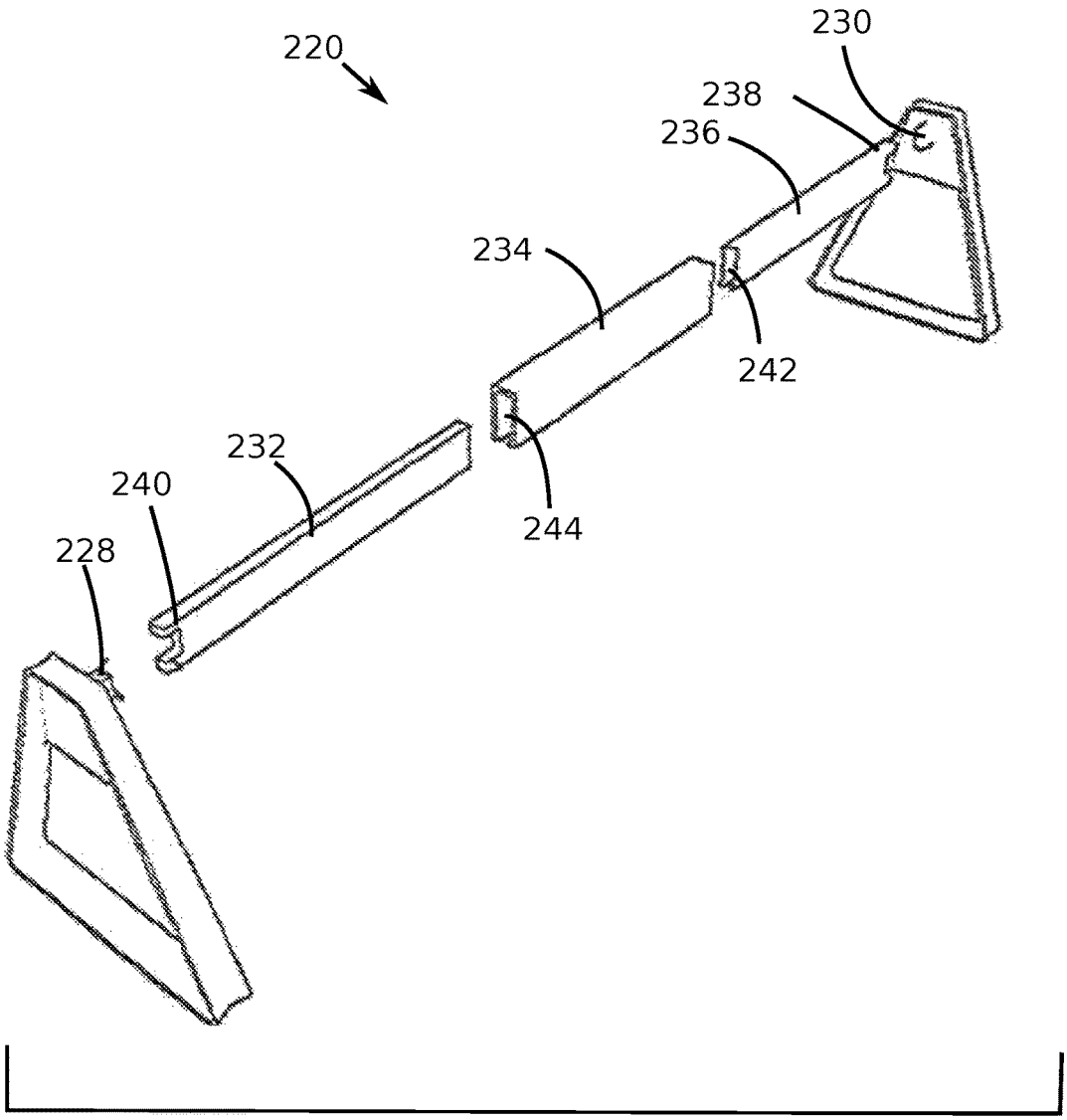
FIG. 22 is a perspective exploded view of the barricade of FIG. 20.

FIGS. 20 through 22 show a second embodiment parking space barricade 220. Barricade 220 comprises a first support member 222, a second support member 226, and a crossbar assembly 224. The first support member 222 and the second support member 226 are similar to A-frame 32 and A-frame 34. The first and second support members 222, 226 each comprise a crossbar mount 228, 230, which are the same as mount 94.

The crossbar assembly 224 comprises a male bar 232, a female bar 236, and a sleeve 234. The female bar 236 comprises a first fork end 238. The first fork end 238 is the same as first end 140. The male bar 232 comprises a second fork end 240. The second fork end 240 is the same as second end 270. The female bar 236 comprises a hollow core 242 that is sized to receive the male bar 232. The sleeve 234 comprises a hollow core 244 that is sized to receive the female bar 236 and the male bar 232. In some embodiments, the sleeve is not used and only the male bar and female bar are used. The sleeve may comprise a laterally centrally located ID tag or label pocket or recess (not labeled), which may be the same as the laterally centrally located ID tag or label pocket or recess 200.

The barricade 220 may be moved between a compact configuration as shown in FIG. 20 and an expanded configuration as shown in FIG. 21. The male bar 232 is received further into the hollow core 242 of the female bar 236 when in the compact configuration as compared to the expanded configuration. The sleeve 234 is received over the female bar and or the male bar as shown in FIGS. 20 and 21. Therefore, the barricade can be configured to occupy more or less space depending on the needs of the user and the location of deployment. In some embodiments, the barricade is 3.5 feet long when in the compact configuration and 6.5 feet long when in the expanded configuration. In some embodiments, the barricade is twice as long in the expanded configuration as compared to the contracted configuration.

The first support member 222 is identical to the second support member 226 so only the second support member will be described in detail. The second support member 222 comprises a first leg 246, a second leg 248, an upper area 250, and a lower crossmember 252. The second support member 222 comprises a generally triangular shape. The first and second legs converge towards the upper area and diverged towards the lower crossmember. The lower crossmember is located at the bottom of each leg so that a continuous surface is provided for support along the lower surface of the crossmember.

The crossbar mounts 228, 230 connect to the fork ends 238, 240 in the same manner as the mount 94 connects to the first end 140. The first and second support members 222, 226 are pivotal/positionable relative to the crossbar assembly 224 in the same manner as the A-frames 32, 34 are pivotal/positionable relative to crossbar 36. In some embodiments, the barricade 30 comprises the crossbar assembly 244 instead of crossbar 36.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A parking space barricade, comprising:

a crossbar;

a first pair of legs;

a second pair of legs;

the crossbar comprises a first fork end and a second fork end, the first fork end is opposite the second fork end, the first pair of legs are joined at a first upper end, the first upper end comprises a first crossbar mount;

the second pair of legs are joined at a second upper end, the second upper end comprises a second crossbar mount;

the first crossbar mount is pivotally connected to the first fork end, the first pair of legs comprise a first vertical pivot axis extending through the first crossbar mount;

the second crossbar mount is pivotally connected to the second fork end, the second pair of legs comprise a second vertical pivot axis extending through the second crossbar mount, the first and second pair of legs each are pivotal between a first stored position, a deployed position, and a second stored position, the first and second pair of legs are transverse to the crossbar when in the deployed position, the first and second pair of legs are adjacent the crossbar when in the first stored position;

the first crossbar mount comprises a first half cylindrical side wall, the first crossbar mount comprises a first upper lock recess and a first lower lock recess each interrupting the first half cylindrical side wall, the first fork end comprises a first upper lock protrusion and a first lower lock protrusion, the first pair of legs is releasably secured in the first stored position when the first upper lock protrusion is in the first upper lock recess and the first lower lock protrusion is in the first lower lock recess;

the second crossbar mount comprises a second half cylindrical side wall, the second crossbar mount comprises a second upper lock recess and a second lower lock recess each interrupting the second half cylindrical side wall, the second fork end comprises a second upper lock protrusion and a second lower lock protrusion, the second pair of legs is releasably secured in the first stored position when the second upper lock protrusion is in the second upper lock recess and the second lower lock protrusion is in the second lower lock recess;

the first crossbar mount comprises a third upper lock recess and a third lower lock recess each interrupting the first half cylindrical side wall opposite the first upper lock recess and the first lower lock recess, the first pair of legs is releasably secured in the second stored position when the first upper lock protrusion is in the third upper lock recess and the first lower lock protrusion is in the third lower lock recess; and, the second crossbar mount comprises a fourth upper lock recess and a fourth lower lock recess each interrupting the second half cylindrical side wall opposite the second upper lock recess and the second lower lock recess, the second pair of legs is releasably secured in the second stored position when the second upper lock protrusion is in the fourth upper lock recess and the second lower lock protrusion is in the fourth lower lock recess.

2. The barricade of claim 1, wherein the first fork end comprises a first upper arm, a first lower arm, and a first gap between the first upper arm and the first lower arm;

the second fork end comprises a second upper arm, a second lower arm, and a second gap between the second upper arm and the second lower arm;

the first upper arm and the first lower arm are pivotally connected to opposite sides of the first crossbar mount, the first crossbar mount is received in the first gap;

the second upper arm and the second lower arm are pivotally connected to opposite sides of the second crossbar mount, the second crossbar mount is received in the second gap.

3. The barricade of claim 2, wherein, the first upper arm comprises a first upper pivot protrusion, the first lower arm comprises a first lower pivot protrusion, the first upper pivot protrusion and the first lower pivot protrusion are vertically aligned and extend into the first gap;

the second upper arm comprises a second upper pivot protrusion, the second lower arm comprises a second lower pivot protrusion, the second upper pivot protrusion and the second lower pivot protrusion are vertically aligned and extend into the second gap;

the first crossbar mount comprises a first upper pivot recess and a first lower pivot recess, the first upper pivot recess and the first lower pivot recess are vertically aligned and are located on opposite sides of the first crossbar mount;

the second crossbar mount comprises a second upper pivot recess and a second lower pivot recess, the second upper pivot recess and the second lower pivot recess are vertically aligned and are located on opposite sides of the second crossbar mount;

the first upper pivot protrusion is received in the first upper pivot recess, the first lower pivot protrusion is received in the first lower pivot recess, the second upper pivot protrusion is received in the second upper pivot recess, the second lower pivot protrusion is received in the second lower pivot recess.

4. The barricade of claim 1, wherein the first fork end comprises a locking rail, the first upper end comprises a crossbar stop recess, the locking rail is received in the crossbar stop recess to releaseably secure the first pair of legs in the deployed position.

5. The barricade of claim 1, wherein the first stored position is 180 degrees from the second stored position, and, the first stored position is 90 degrees from the deployed position.

6. The barricade of claim 1, wherein the first pair of legs are aligned longitudinally with the second pair of legs when in the first stored position and when in the second stored position.

7. The barricade of claim 1, wherein the first pair of legs are parallel to the second pair of legs when in the deployed position; the first and second pair of legs overlap the crossbar and each of the first pair of legs are aligned with each of the second pair of legs when in the first stored position and when in the second stored position.

8. The barricade of claim 1, wherein the first pair of legs comprise a first upper stacking recess at the first upper end on an outside side of the first pair of legs opposite of the first crossbar mount;

the second pair of legs comprise a second upper stacking recess at the second upper end on the outside side of the second pair of legs opposite of the second crossbar mount;

each leg of the first pair of legs comprise a first lower stacking recess on a side of each leg opposite of the first crossbar mount;

each leg of the first pair of legs comprise a first lower stacking protrusion on a same side as the first crossbar mount;

each leg of the second pair of legs comprise a second lower stacking recess on a side of each leg opposite of the second crossbar mount;

each leg of the second pair of legs comprise a second lower stacking protrusion on a same side as the second crossbar mount.

9. The barricade of claim 1, wherein the first pair of legs is removably attached to the crossbar, and the second pair of legs is removably attached to the crossbar.

10. The barricade of claim 1, comprising a first A-frame and a second A-frame, the first A-frame comprises the first pair of legs, the second A-frame comprises the second pair of legs.

11. The barricade of claim 1, wherein the crossbar is expandable from at least one retracted position to at least one expanded position, where the crossbar comprises a length that is longer in the at least one expanded position than the at least one retracted position.

12. The barricade of claim 1, wherein, the first upper lock recess and the first lower lock recess are vertically aligned;

the third upper lock recess and the third lower lock recess are vertically aligned;

the second upper lock recess and the second lower lock recess are vertically aligned; and, the fourth upper lock recess and the fourth lower lock recess are vertically aligned.

13. The barricade of claim 12, wherein, the first upper lock recess and the third upper lock recess are horizontally aligned;

the first lower lock recess and the third lower lock recess are horizontally aligned;

the second upper lock recess and the fourth upper lock recess are horizontally aligned; and, the second lower lock recess and the fourth lower lock recess are horizontally aligned.

14. The barricade of claim 13, wherein, the first upper lock recess and the third upper lock recess and the first upper lock protrusion are horizontally aligned;

the first lower lock recess and the third lower lock recess and the first lower lock protrusion are horizontally aligned;

the second upper lock recess and the fourth upper lock recess and the second upper lock protrusion are horizontally aligned; and, the second lower lock recess and the fourth lower lock recess and the second lower lock protrusion are horizontally aligned.

15. A parking space barricade, comprising:

a crossmember;

a first pair of legs, a second pair of legs, the crossmember comprises a first fork end and a second fork end, the first fork end is opposite the second fork end, the first pair of legs are joined at a first upper end, the first upper end comprises a first crossmember mount;

the second pair of legs are joined at a second upper end, the second upper end comprises a second crossmember mount;

the first crossmember mount is pivotally connected to the first fork end, the first pair of legs comprise a first vertical pivot axis extending through the first crossmember mount;

the second crossmember mount is pivotally connected to the second fork end, the second pair of legs comprise a second pivot vertical axis extending through the second crossmember mount, the first and second pair of legs each are pivotal between a first stored position, a deployed position, and a second stored position, the first and second pair of legs are transverse to the crossmember when in the deployed position, the first and second pair of legs are adjacent the crossmember when in the first stored position;

the first crossmember mount comprises a first half cylindrical side wall, the first crossmember mount comprises a first upper lock recess and a first lower lock recess each interrupting the first half cylindrical side wall, the first fork end comprises a first upper lock protrusion and a first lower lock protrusion, the first pair of legs is releasably secured in the first stored position when the first upper lock protrusion is in the first upper lock recess and the first lower lock protrusion is in the first lower lock recess;

the second crossmember mount comprises a second half cylindrical side wall, the second crossmember mount comprises a second upper lock recess and a second lower lock recess each interrupting the second half cylindrical side wall, the second fork end comprises a second upper lock protrusion and a second lower lock protrusion, the second pair of legs is releasably secured in the first stored position when the second upper lock protrusion is in the second upper lock recess and the second lower lock protrusion is in the second lower lock recess;

the first crossmember mount comprises a third upper lock recess and a third lower lock recess each interrupting the first half cylindrical side wall opposite the first upper lock recess and the first lower lock recess, the first pair of legs is releasably secured in the second stored position when the first upper lock protrusion is in the third upper lock recess and the first lower lock protrusion is in the third lower lock recess; and, the second crossmember mount comprises a fourth upper lock recess and a fourth lower lock recess each interrupting the second half cylindrical side wall opposite the second upper lock recess and the second lower lock recess, the second pair of legs is releasably secured in the second stored position when the second upper lock protrusion is in the fourth upper lock recess and the second lower lock protrusion is in the fourth lower lock recess.

16. The barricade of claim 15, wherein the first fork end comprises a first upper arm, a first lower arm, and a first gap between the first upper arm and the first lower arm;

the second fork end comprises a second upper arm, a second lower arm, and a second gap between the second upper arm and the second lower arm;

the first upper arm and the first lower arm are pivotally connected to opposite sides of the first crossmember mount, the first crossmember mount is received in the first gap;

the second upper arm and the second lower arm are pivotally connected to opposite sides of the second crossmember mount, the second crossmember mount is received in the second gap.

17. The barricade of claim 16, wherein, the first upper arm comprises a first upper pivot protrusion, the first lower arm comprises a first lower pivot protrusion, the first upper pivot protrusion and the first lower pivot protrusion are vertically aligned and extend into the first gap;

the second upper arm comprises a second upper pivot protrusion, the second lower arm comprises a second lower pivot protrusion, the second upper pivot protrusion and the second lower pivot protrusion are vertically aligned and extend into the second gap;

the first crossmember mount comprises a first upper pivot recess and a first lower pivot recess, the first upper pivot recess and the first lower pivot recess are vertically aligned and are located on opposite sides of the first crossmember mount;

the second crossmember mount comprises a second upper pivot recess and a second lower pivot recess, the second upper pivot recess and the second lower pivot recess are vertically aligned and are located on opposite sides of the second crossmember mount;

the first upper pivot protrusion is received in the first upper pivot recess, the first lower pivot protrusion is received in the first lower pivot recess, the second upper pivot protrusion is received in the second upper pivot recess, the second lower pivot protrusion is received in the second lower pivot recess.

18. A parking barricade, comprising a crossmember, a first vertical support member;

a second vertical support member;

the crossmember comprises a first fork end and a second fork end, the first fork end is opposite the second fork end, the first vertical support member comprises a first upper end, the first upper end comprises a first crossmember mount;

the second vertical support member comprises a second upper end, the second upper end comprising a second crossmember mount;

the first crossmember mount is pivotally connected to the first fork end, the first vertical support member comprise a first vertical pivot axis extending through the first crossmember mount;

the second crossmember mount is pivotally connected to the second fork end, the second vertical support member comprise a second vertical pivot axis extending through the second crossmember mount, the first and second vertical support members each are pivotal between a first stored position, a deployed position, and a second stored position, the first and second vertical support members are transverse to the crossmember when in the deployed position, the first and second vertical support members are adjacent the crossmember when in the first stored position and when in the second stored position;

the first crossmember mount comprises a first half cylindrical side wall, the first crossmember mount comprises a first upper lock recess and a first lower lock recess each interrupting the first half cylindrical side wall, the first fork end comprises a first upper lock protrusion and a first lower lock protrusion, the first vertical support member is releasably secured in the first stored position when the first upper lock protrusion is in the first upper lock recess and the first lower lock protrusion is in the first lower lock recess;

the second crossmember mount comprises a second half cylindrical side wall, the second crossmember mount comprises a second upper lock recess and a second lower lock recess each interrupting the second half cylindrical side wall, the second fork end comprises a second upper lock protrusion and a second lower lock protrusion, the second vertical support member is releasably secured in the first stored position when the second upper lock protrusion is in the second upper lock recess and the second lower lock protrusion is in the second lower lock recess;

the first crossmember mount comprises a third upper lock recess and a third lower lock recess each interrupting the first half cylindrical side wall opposite the first upper lock recess and the first lower lock recess, the first vertical support member is releasably secured in the second stored position when the first upper lock protrusion is in the third upper lock recess and the first lower lock protrusion is in the third lower lock recess; and, the second crossmember mount comprises a fourth upper lock recess and a fourth lower lock recess each interrupting the second half cylindrical side wall opposite the second upper lock recess and the second lower lock recess, the second vertical support member is releasably secured in the second stored position when the second upper lock protrusion is in the fourth upper lock recess and the second lower lock protrusion is in the fourth lower lock recess.

* * * * *